US009970636B1

(12) United States Patent
Winters

(10) Patent No.: US 9,970,636 B1
(45) Date of Patent: May 15, 2018

(54) RECESSED AND ADJUSTABLE LIGHT FIXTURE

(71) Applicant: Philip Dean Winters, Senoia, GA (US)

(72) Inventor: Philip Dean Winters, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 43 days.

(21) Appl. No.: 14/976,000

(22) Filed: Dec. 21, 2015

(51) Int. Cl.
*F21V 21/30* (2006.01)
*F21S 8/02* (2006.01)

(52) U.S. Cl.
CPC ..... *F21V 21/30* (2013.01); *F21S 8/026* (2013.01)

(58) Field of Classification Search
USPC ..... 362/371
See application file for complete search history.

(56) References Cited

U.S. PATENT DOCUMENTS 8,226,278 B2 * 7/2012 Ward ..... F21S 8/02 362/365
8,727,583 B2 * 5/2014 Russo ..... F21V 21/04 362/364
2010/0110698 A1 * 5/2010 Harwood ..... F21V 21/04 362/365

OTHER PUBLICATIONS

Lightolier, Lytecaster Recessed Downlighting; 1127, Product Specification, Jan. 2007.

* cited by examiner

*Primary Examiner* — Michael G Lee
*Assistant Examiner* — David Tardif
(74) *Attorney, Agent, or Firm* — King & Spalding LLP

(57) ABSTRACT

A lighting system includes a pivot bracket that includes a first arm, a second arm, and a connector band that couples both the arms. The pivot bracket is pivotably coupled to a trim assembly at the first end of each arm such that the pivot bracket is pivotable with respect to the trim assembly about a first axis of rotation defined by and axially passing through a first aperture of each arm located at the respective arm's first end. Further, the pivot bracket is pivotably coupled to a socket bracket at an opposite second end of each arm such that the socket bracket is pivotable with respect to the pivot bracket about a second axis of rotation defined by and axially passing through a second aperture of each arm located at the respective arm's second end. Further, the lighting system includes a light source coupled to the socket bracket.

18 Claims, 10 Drawing Sheets

RECESSED AND ADJUSTABLE LIGHT FIXTURE

TECHNICAL FIELD

Embodiments of the invention relate generally to lighting systems. Specifically, embodiments of the present disclosure relate to recessed light fixtures having multiple pivot points for providing enhanced adjustment options and improved light output from recessed light fixtures.

BACKGROUND

In recessed light fixtures, a measure of how 'recessed' or how far into the ceiling the light source of the recessed light fixture is positioned is generally referred to as 'regression' of the recessed light fixture. For example, a fixture with full, maximum, or "deep" regression means that the light source of the recessed light fixture is seated high up into the housing/ceiling. Typically, to reduce the amount of glare experienced by occupants in the room, it is desirable to have maximum/deep regression. However, as the regression increases, i.e., as the light source is moved further into the housing/ceiling, the amount of usable light from light source is compromised. Accordingly, there is a need for technology that allows the recessed light fixture to have maximum regression while still allowing for and/or maximizing the cone spread (light emitted from a recessed light fixture is typically in the shape of a cone) of usable light emitted from the light source.

SUMMARY

In one aspect, the present disclosure can relate to a lighting system. The lighting system includes a trim assembly that has a light source receiving opening, a light emitting opening, and a trim body extending from the light source receiving opening to the light emitting opening. Further, the lighting system includes a pivot bracket that has a first arm and a second arm. Furthermore, the lighting system includes a socket bracket that comprises a top member and two side flanges. Each side flange may extend substantially perpendicular to the top member from opposite edges of the top member. In addition, the lighting system includes a light source that is coupled to the socket bracket via a light source receiving member disposed on the top member of the socket bracket such that a light emitted by the light source exits through the light emitting opening of the trim assembly. In particular, the pivot bracket is pivotably coupled to: (i) the trim assembly at a proximal end of the first arm and the second arm and defining a first axis of rotation, and (ii) each side arm of the socket bracket at a distal end of the first arm and the second arm, respectively, and defining a second axis of rotation.

In another aspect, the present disclosure can relate to a lighting fixture. The lighting fixture includes a pivot bracket that is pivotably couplable to a trim assembly at a first end of the pivot bracket and comprises a first arm and a second arm. Further, the lighting fixture includes a socket bracket that is pivotably coupled to a second end of the pivot bracket. The second end of the pivot bracket is opposite to the first end. In particular, the first end of the pivot bracket comprises a first end of each of the first arm and the second arm, and the second end of the pivot bracket comprises a second end of each of the first arm and the second arm. Furthermore, the lighting fixture includes a light source that is coupled to the socket bracket and is configured to emit light toward an opening in the trim assembly.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
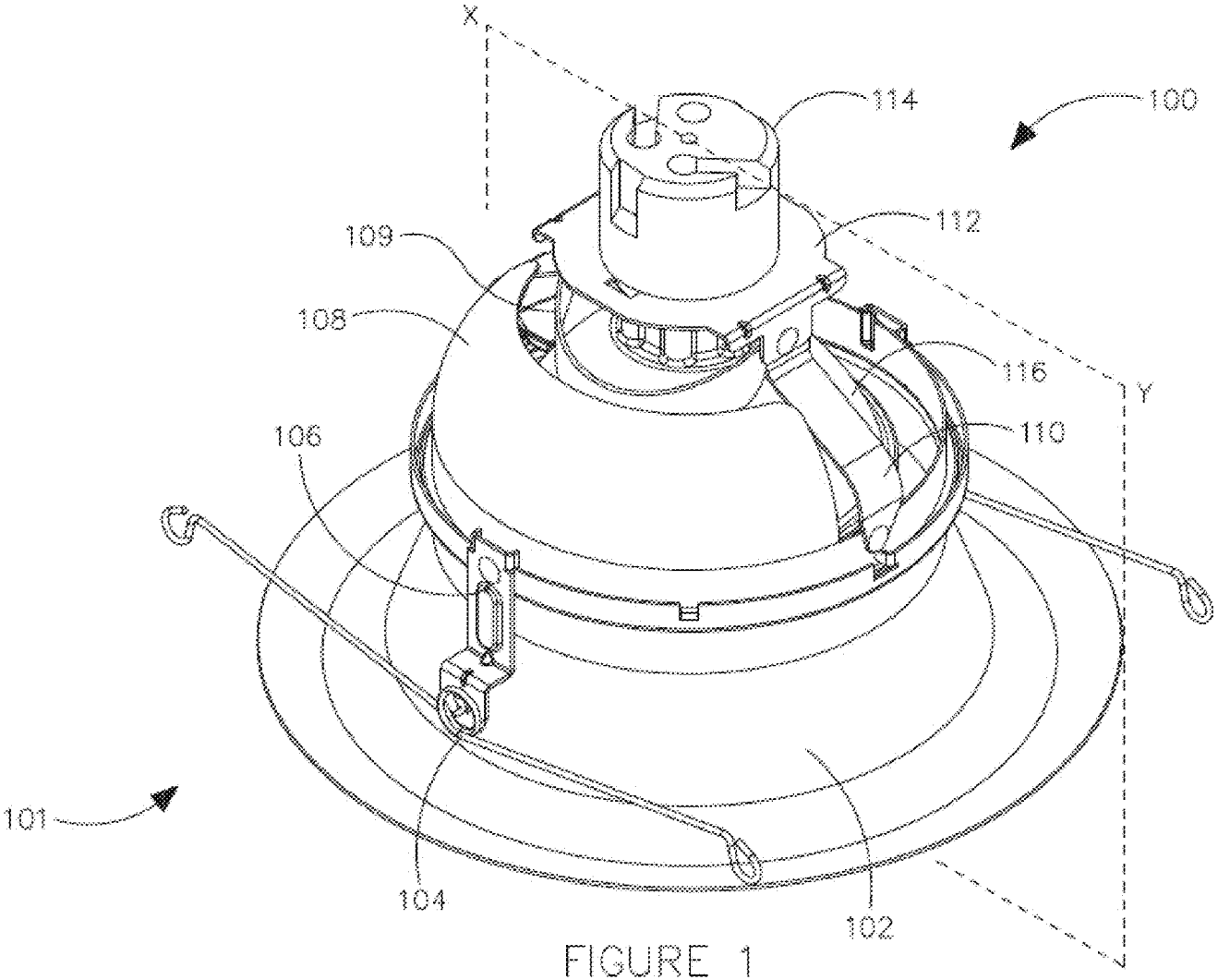
FIG. 1 illustrates a perspective view of a recessed light fixture having multiple pivot points, in accordance with example embodiments of the present disclosure.

The drawings illustrate only example embodiments of the invention and are therefore not to be considered limiting of its scope, as the invention may admit to other equally effective embodiments. In the drawings, reference numerals designate like or corresponding, but not necessarily identical, elements.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure is directed to an example recessed light fixture having multiple sets of pivot points that provide multiple axes of rotation for the recessed light fixture. In particular, the example recessed light fixture of the present disclosure includes two sets of at least two pivot points, each set of pivot points defining a respective axis of rotation. For example, a first set of pivot points may be positioned at a distance below a second set of pivot points and may define a first axis of rotation, and the second set of pivot points may define a second axis of rotation. In said example, the first set of pivot points, i.e., the lower set of pivot points pivots about the first axis of rotation to aim a light source of the recessed light fixture at a maximum angle with respect to a central axis of the recessed lighting fixture. The second set of pivot points, then allows the recessed light fixture to be further rotated about the second axis of rotation to direct the center beam of the light source (which is the central portion of the cone of light) onto the desired area/surface. The additional rotational axis increases the amount of direct (non-reflected) usable light output from the recessed light fixture while being in maximum/deep regression.

The technology of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "exemplary embodiments" given herein are intended to be non-limiting and among others supported by representations of the present technology.

Figure 2:
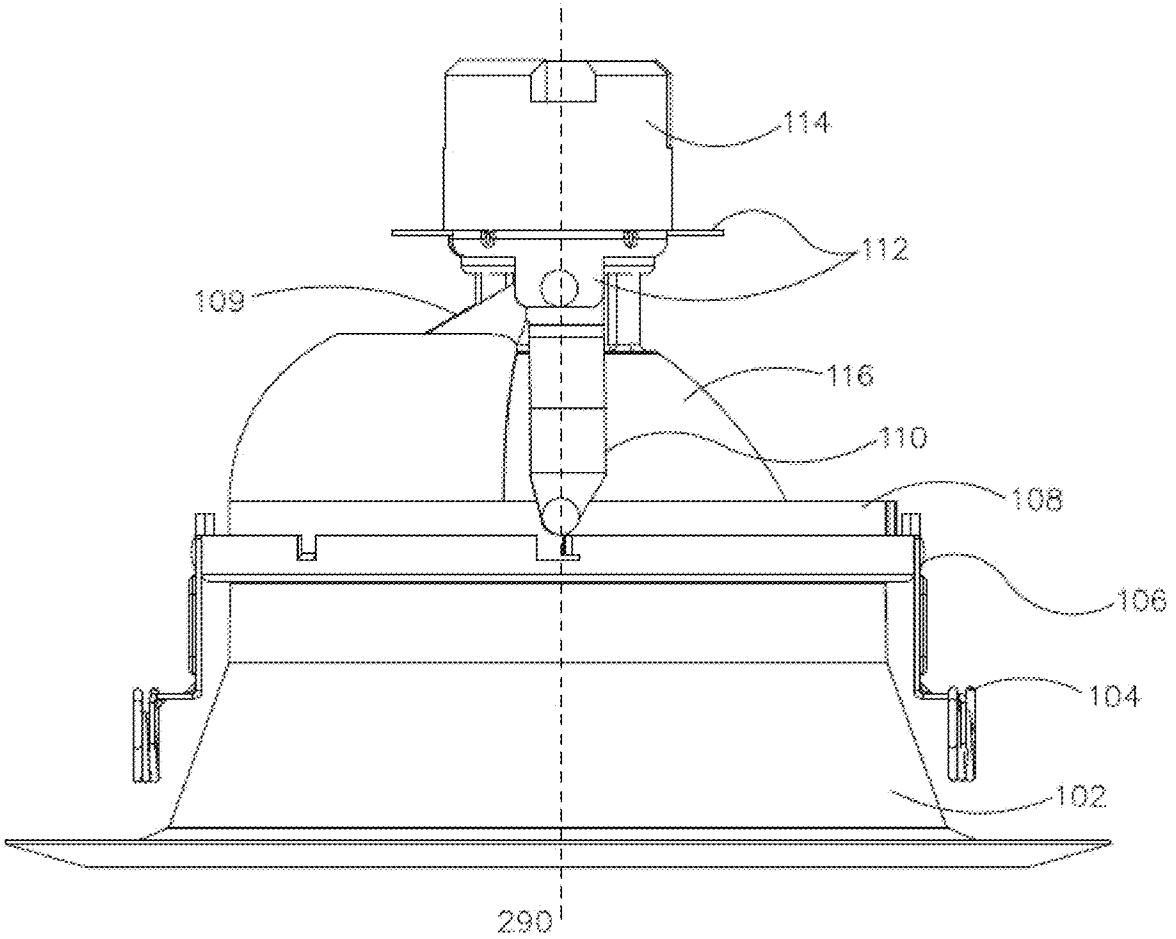
FIG. 2 illustrates a side view of the recessed light fixture of FIG. 1 from a first side, in accordance with example embodiments of the present disclosure.
Figure 3:
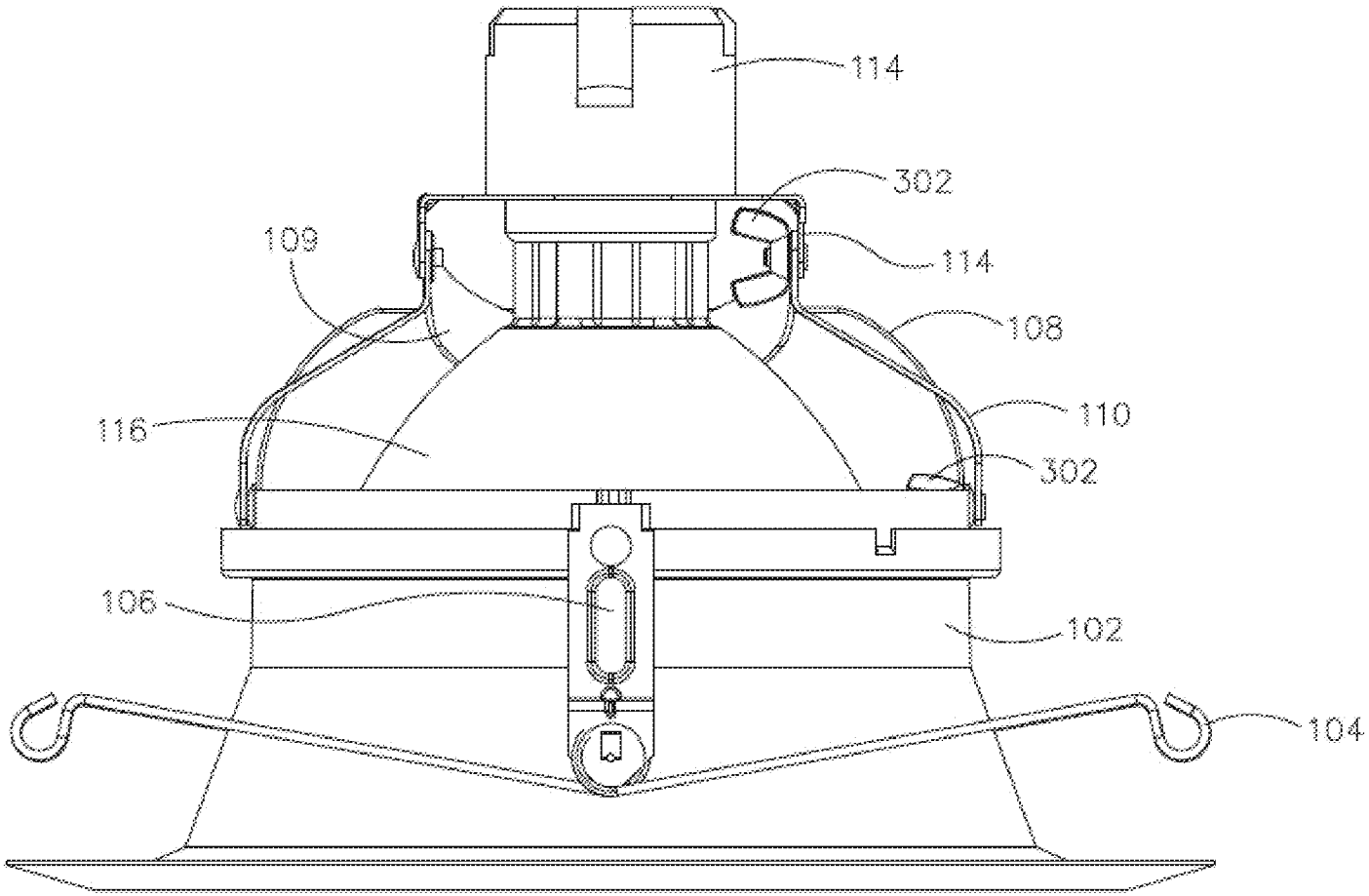
FIG. 3 illustrates a side view of the recessed light fixture of FIG. 1 from a second side, in accordance with example embodiments of the present disclosure.
Figure 4:
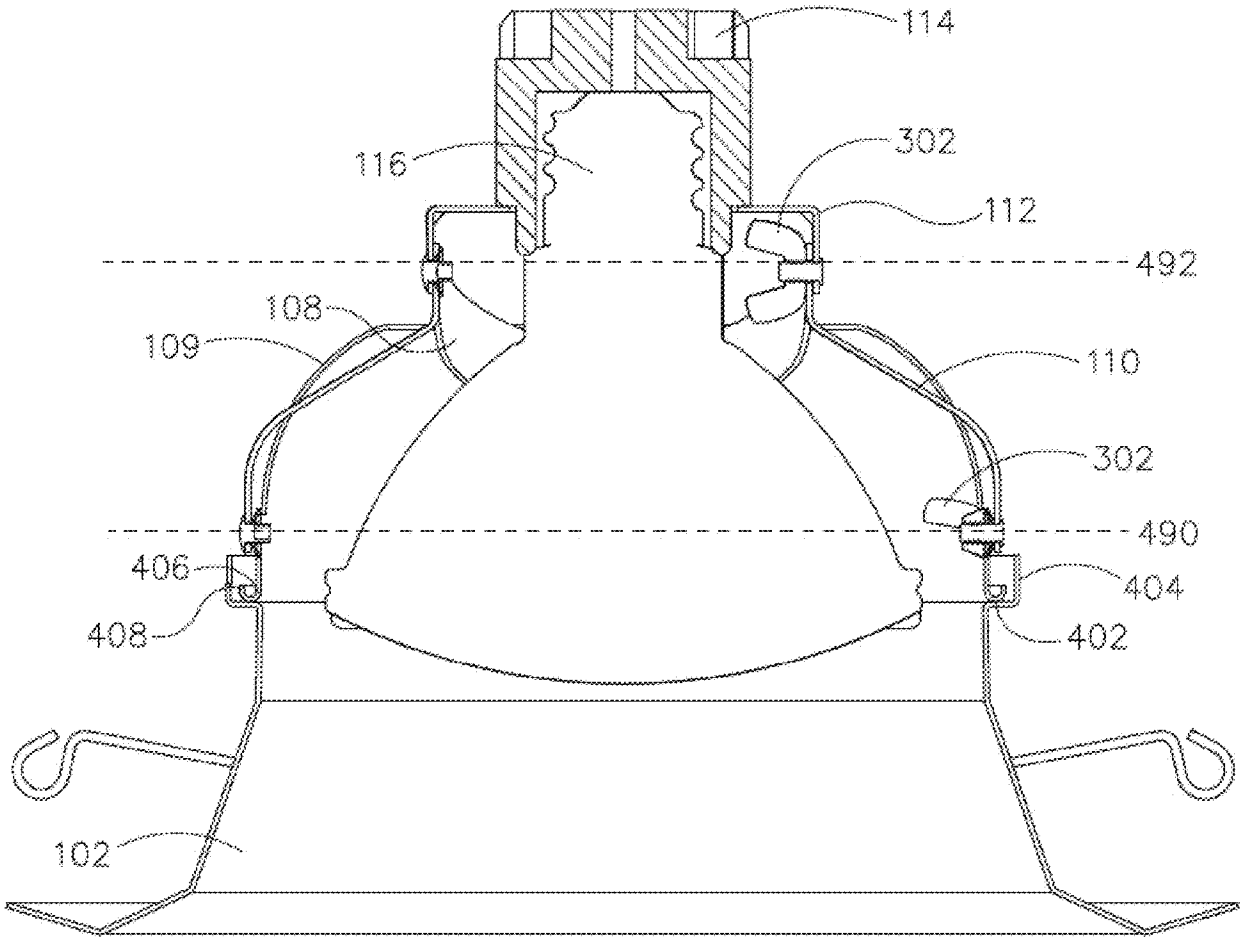
FIG. 4 illustrates a cross sectional view of the recessed light fixture having multiple pivot points along the X-X plane illustrated in FIG. 1, in accordance with example embodiments of the present disclosure.

FIGS. 1-4 illustrate various views of the recessed light fixture having multiple pivot points, according to example embodiments of the present disclosure. In particular, FIG. 1 illustrates a perspective view of a recessed light fixture having multiple pivot points, in accordance with example embodiments of the present disclosure; FIG. 2 illustrates a side view of the recessed light fixture of FIG. 1 from a first side, in accordance with example embodiments of the present disclosure; FIG. 3 illustrates a side view of the recessed light fixture of FIG. 1 from a second side, in accordance with example embodiments of the present disclosure; FIG. 4 illustrates a cross sectional view of the recessed light fixture having multiple pivot points along the X-X plane illustrated in FIG. 1, in accordance with example embodiments of the present disclosure.

Figure 5:
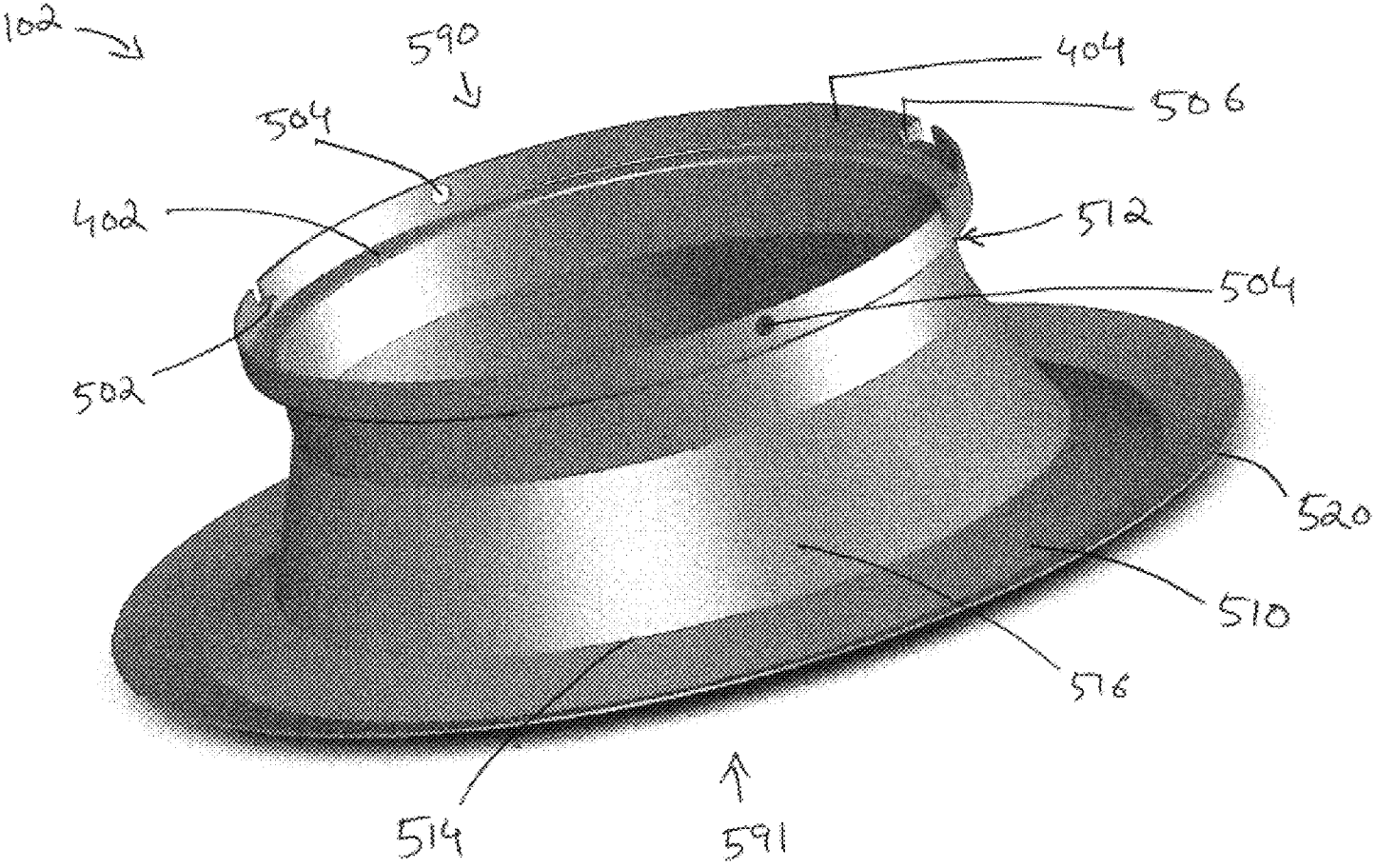
FIG. 5 illustrates a trim ring of the recessed light fixture having multiple pivot points illustrated in FIG. 1, in accordance with example embodiments of the present disclosure.
Figure 6:
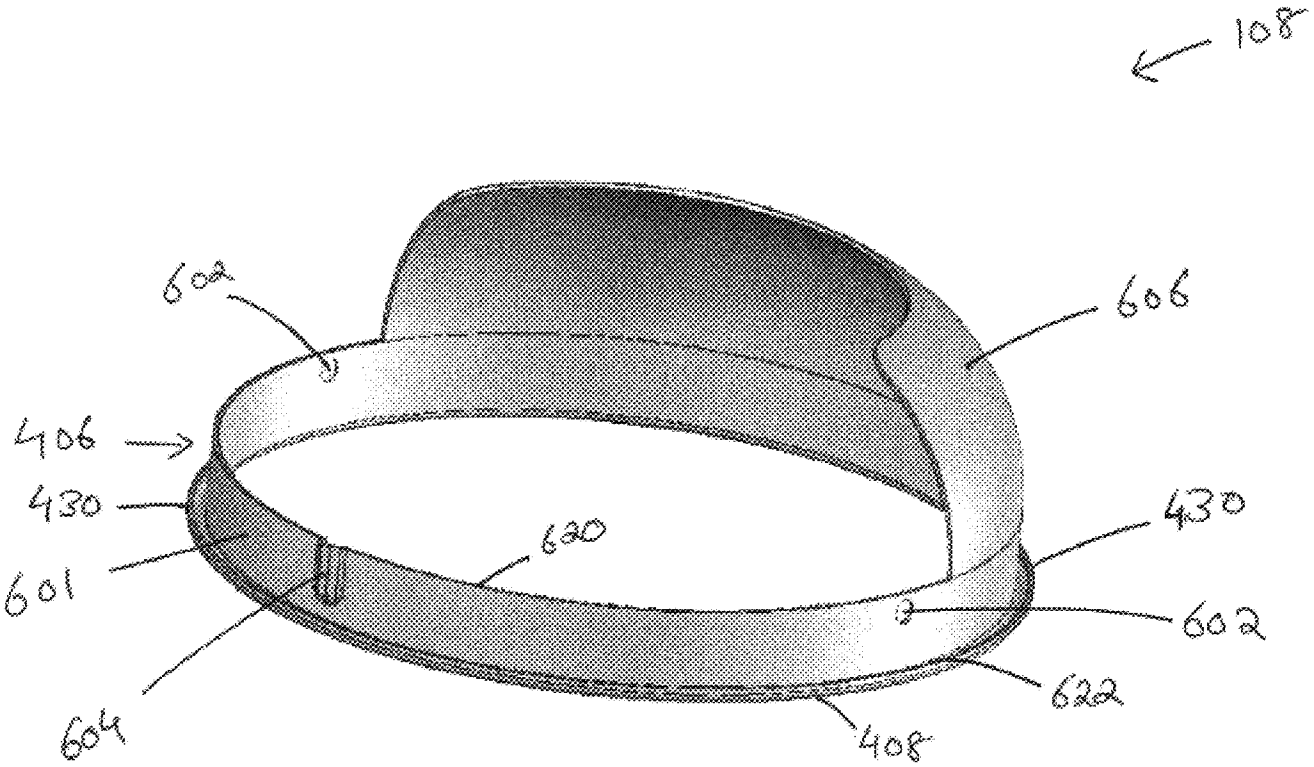
FIG. 6 illustrates a spin ring of the recessed light fixture having multiple pivot points illustrated in FIG. 1, in accordance with example embodiments of the present disclosure.
Figure 7:
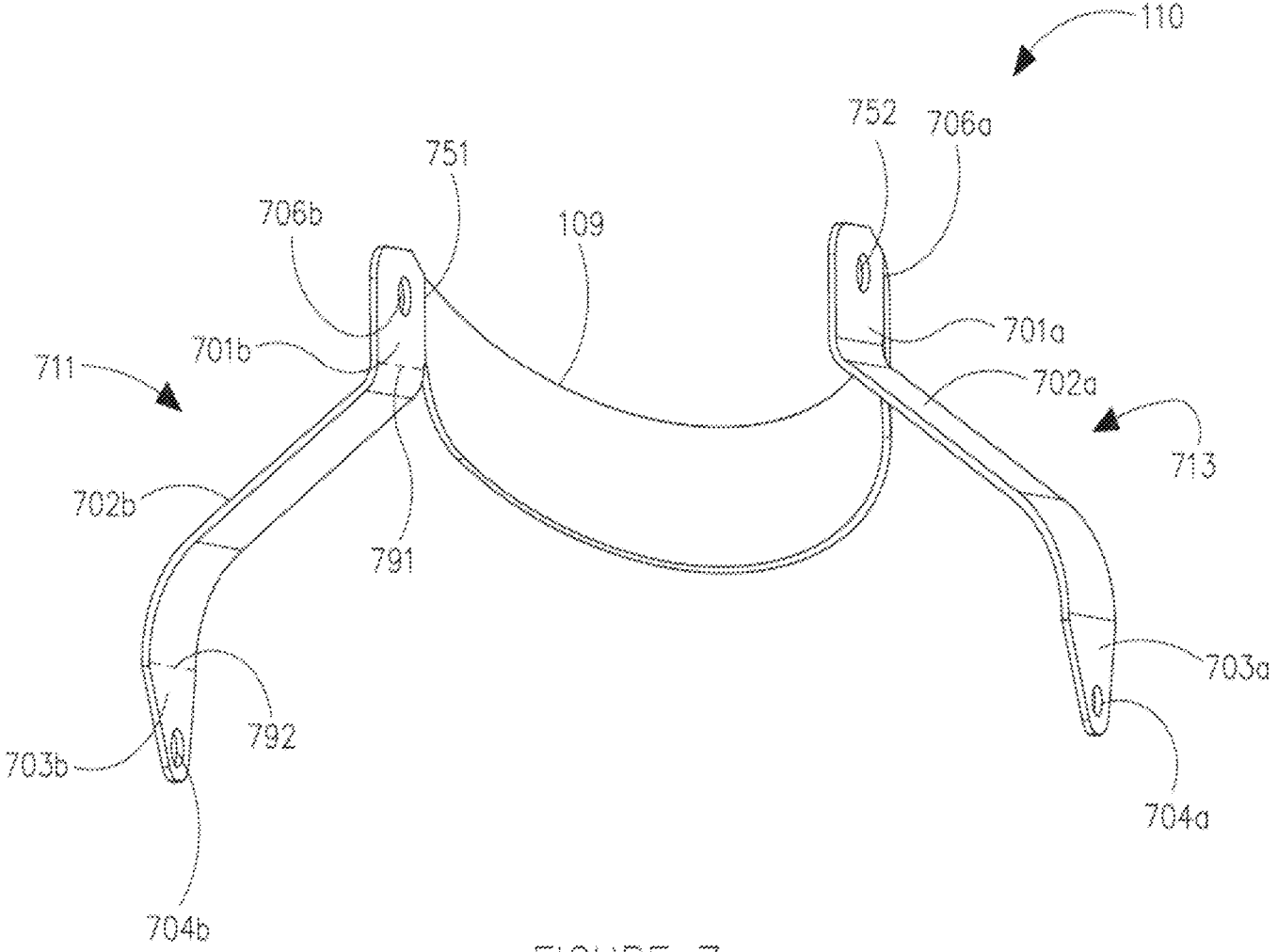
FIG. 7 illustrates a pivot bracket of the recessed light fixture having multiple pivot points illustrated in FIG. 1, in accordance with example embodiments of the present disclosure.
Figure 8:
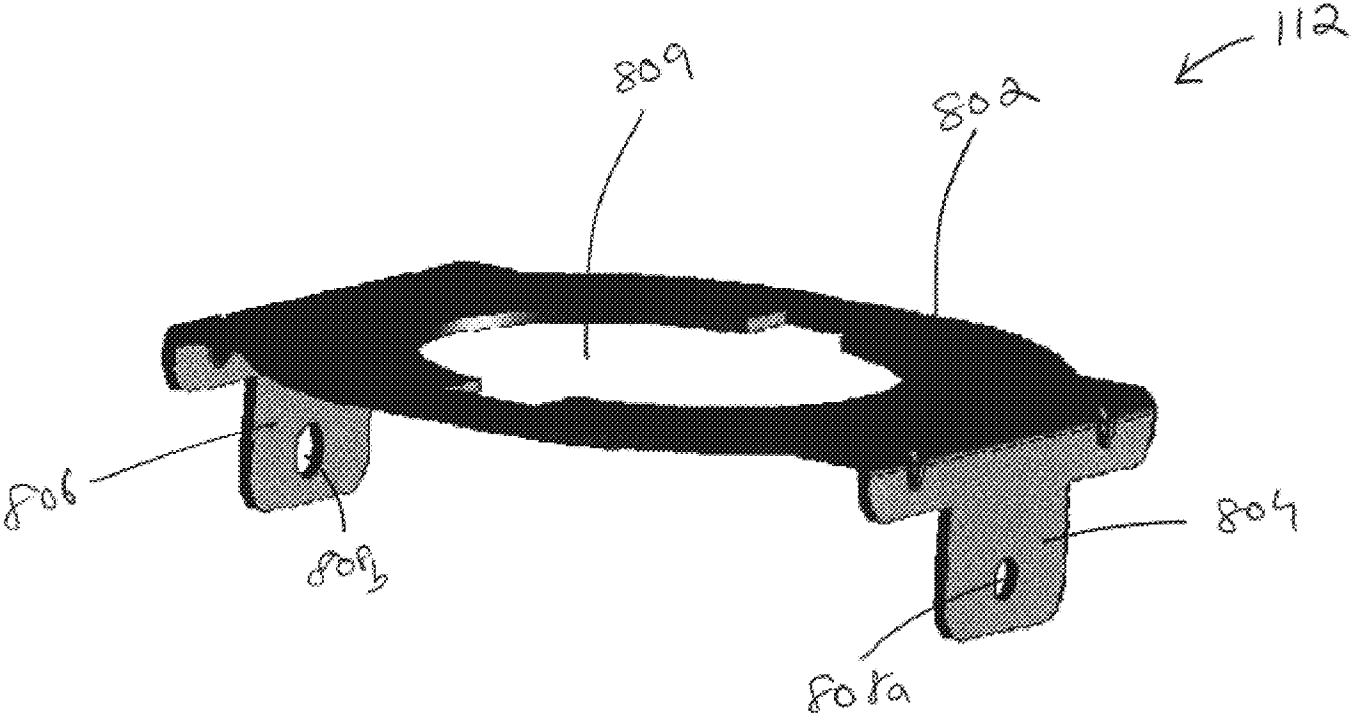
FIG. 8 illustrates a socket bracket of the recessed light fixture having multiple pivot points illustrated in FIG. 1, in accordance with example embodiments of the present disclosure.

Further, FIG. 5-7 illustrate various components of the recessed light fixture of FIG. 1, according to example embodiments of the present disclosure. In particular, FIG. 5 illustrates a trim ring of the recessed light fixture having multiple pivot points illustrated in FIG. 1, in accordance with example embodiments of the present disclosure; FIG. 6 illustrates a spin ring of the recessed light fixture having multiple pivot points illustrated in FIG. 1, in accordance with example embodiments of the present disclosure; FIG. 7 illustrates a pivot bracket of the recessed light fixture having multiple pivot points illustrated in FIG. 1, in accordance with example embodiments of the present disclosure; and FIG. 8 illustrates a socket bracket of the recessed light fixture having multiple pivot points illustrated in FIG. 1, in accordance with example embodiments of the present disclosure.

Referring to FIGS. 1-8, a recessed light fixture 100 may include a trim assembly 101. The trim assembly 101 may include a trim unit 102 that is coupled to a spin ring 108. In particular, as illustrated in FIG. 5, the trim unit 102 may include a top annular edge 512 that defines a light source receiving opening 590 (hereinafter interchangeably referred to as a 'first opening'), and a bottom annular edge 514 that is opposite to the top annular edge 512 and defining a light emitting opening 591 (hereinafter interchangeably referred to as a 'second opening'). Further, the trim unit 102 may include a trim body 516 that extends between the top annular edge 512 and the bottom annular edge 514. In certain example embodiments, the bottom annular edge 514 may be larger in diameter than the top annular edge 512, providing a cone frustum like shape to the trim unit 102. Even though the figures of the present disclosure illustrate a trim unit 102 shaped substantially like a cone frustum, one of ordinary skill can understand and appreciate that the trim unit can assume any other appropriate shapes in other embodiments without departing from a broader scope of the present disclosure. For example, the trim unit 102 may have a cylindrical shape, a rectangular shape, and so on.

Further, a top portion of the trim unit 102 may include (i) a shoulder 402 that extends radially outward from the top annular edge 514 in a direction away from the light source receiving opening 590 defined by the top annular edge 516, and (ii) a top collar 404 that extends substantially perpendicular to the shoulder from an outer edge (the edge away from the trim body 516) of the shoulder 402. Furthermore, a bottom portion of the trim unit 102 may include a flange 510 that extends radially outward from the bottom annular edge 514 of the trim unit 102. An outer edge 520 of the flange, i.e., the edge that is away from the trim body 516 may be larger in diameter than the bottom annular edge 514 of the trim unit 102.

As illustrated in FIG. 5, the top collar 404 of the trim unit 102 may include one or more apertures 504 for coupling of the trim unit 102 to one or more torsion spring brackets 106, respectively, using a fastener, such as a screw, rivet, etc. However, one of ordinary skill in the art can understand and appreciate that any other coupling mechanism may be used to couple the torsion spring bracket to the trim unit without departing from a broader scope of the present disclosure. In addition, one of ordinary skill in the art could use other attachment methods beyond torsion springs (i.e.—friction blades, screws, etc.)

Each torsion spring bracket 106 may include a torsion spring 104 coupled to the torsion spring bracket 106. When installing the recessed light fixture 100 within a ceiling using a housing canister, the prongs of the torsion spring 104 are pinched together and coupled to torsion spring receivers in the housing canister and/or the ceiling. Then, the prongs of the torsion spring 104 are allowed to spread out into their default position. As the prongs spread outward to their default position, the recessed light fixture 100 is pulled upward into the housing canister until the flange 510 of the trim unit 102 grips or is pulled against the ceiling and/or the bottom edge of the housing canister. That is, the flange 510 may be larger than an opening in the ceiling within which the recessed light fixture 100 is positioned. Alternatively, in other example embodiments, the flange 510 may be smaller than the opening in the ceiling such that the outer edge 520 of the flange 510 may be flush with the opening of the ceiling.

Referring to FIG. 5, in certain example embodiments, the trim unit 102 further includes a plurality of locking tabs 502 located at different positions on the top collar 404 of the trim unit 102. In one example embodiment, the locking tabs 502 are partially cut from the top collar 404 such that they hinge from the top collar 404 of the trim unit 102. Initially, the locking tabs 502 may be completely flush with the top collar 404. However, as illustrated in FIG. 5, during assembly, the locking tabs 502 may be pried out/bent out towards a direction of the light source receiving opening 590 from being completely flush with the top collar 404 to being substantially perpendicular to the top collar 404, or any degree therebetween, in order to securely couple the spin ring 108 to the trim unit 102. In other words, the locking tabs 502 may be used to securely couple the spin ring 108 to the trim unit 102 forming the trim assembly 101.

As illustrated in FIG. 6, the spin ring 108 includes a ring portion 406 having a top edge 620, a bottom edge 622, and a ring body/side wall 601 that extends from the top edge 620 to the bottom edge 622. Further, the spin ring 108 includes a flange 408 that extends substantially perpendicular to the ring body/side wall 601 from the bottom edge 622 of the ring portion 406. In particular, the flange 408 may extend in a direction away from the light source 116 (towards the housing canister). Furthermore, the outer edge 430 of the flange 408, i.e., the edge away from the ring body/side wall 601 may be curved upwards such that the ring portion 406 may have a substantially J-shaped cross-section as illustrated in FIG. 4. When installing the recessed light fixture 100, the spin ring 108 may be coupled to the trim unit 102 such that the flange 408 of the spin ring 108 may rest on the shoulder 402 of the trim unit 102. Then, to securely retain the spin ring 108 to the trim unit 102, the locking tabs 502 of the trim unit 102 may be bent out in the direction of the flange 408 of the spin ring 108 such that it rests over/above the outer edge 430 of the flange 408 that is curved upwards. Accordingly, once the light fixture is suspended or housed within the ceiling, the curved outer edge 430 of the spin ring's flange 408 may engage the bent out locking tabs 402 resting above the flange 408, thus coupling the trim unit 102 to the spin ring 108 and holding the trim assembly 101 together.

In certain example embodiments, the spin ring 108 may be rotatably coupled to the trim unit 102. That is, the spin ring 108 may be rotatable with respect to and independent of the trim unit 102 about a central axis 290 of the recessed light fixture 100 to adjust a positioning of the light source 116 during installation. As illustrated in FIG. 6, the ring portion 406 of the spin ring 108 may include a rotation stopper projection 604 (hereinafter 'stopper projection') that engages with a stopper tab 506 of the trim unit 102 to prevent a rotation of the spin ring past a 360 degree rotation. Similar to the locking tabs 502 described above, initially, the stopper tab 506 may be completely flush with the top collar 404. However, as illustrated in FIG. 5, during installation, the stopper tab 504 may be pried out/bent out towards a direction of the light source receiving opening 590 (away from the housing canister) from being completely flush with the top collar 404 to being substantially perpendicular to the top collar 404, or any degree therebetween, such that it engages the stopper projection 604 of the spin ring 108 to prevent rotation beyond a certain degree. The stop mechanism (combination of stopper tab 506 in the trim unit 102 and the stopper projection 604 in the spin ring 108) protects the electrical connections (e.g., wires) of the recessed light fixture 100 from potential damage resulting from over rotation and excessive twisting of the electrical connections.

Further, the spin ring 108 includes a partial dome portion 606 that extends from the top edge 620 of the ring portion 406. In particular, as illustrated in FIG. 6, the partial dome portion 606 may extend along a portion of the ring portion's circumference to block a user's view up into the housing canister from below once the light fixture 100 is installed into the ceiling. One of ordinary skill in the art can understand and appreciate that in certain example embodiments, the spin ring 108 may not include the partial dome portion 606.

As illustrated in FIGS. 1-4, the light fixture 100 may further include a pivot bracket 110 that is coupled to the spin ring 108 at one end and a socket bracket 112 at an opposite distal end. In particular, as illustrated in FIG. 7, the pivot bracket 110 may include a first arm 711, a second arm 713, and a connector band 109 that connects the first arm 711 to the second arm 713. Each arm (711, 713) includes (i) a substantially planar top portion 701 (hereinafter 'top portion'), (ii) a curved middle portion 702 that extends at an angle to the top portion 701 from a bottom edge 791 of the top portion 701, and (iii) a substantially planar bottom portion 703 (hereinafter 'third portion') that extends at an angle to the curved middle portion 702 from a bottom edge 792 of the curved middle portion 702. Further, the top portion 701 and the bottom portion 703 may be substantially parallel to each other. The curved middle portion 702 of each arm (711, 713) may extend downwards from the top portion 701 towards the bottom portion 703 of the respective arm (711, 713) at an angle that separates the top portion 701 from the bottom portion 703 both vertically and horizontally.

Further, the connector band 109 of the pivot bracket 110 may be a curved structure that extends sideways from the top portion 701*a* of the first arm 711 to the top portion 701*b* of the second arm 713. The connector band 109 provides structural stability to the pivot bracket 110 and prevents a rotation of one arm independent of the other arm. In other words, the connector band 109 aids a rotation of both the arms (711, 713) of the pivot bracket 110 in unison. Furthermore, the top portion 701 of each arm (711, 713) of the pivot bracket 110 includes a first aperture 706, and the bottom portion 703 of each arm (711, 713) of the pivot bracket 110 includes a second aperture 704.

In certain example embodiments, the bottom portion (703*a*, 703*b*) of each arm (711, 713) of the pivot bracket 110 may be pivotally coupled to the spin ring 108. In particular, to pivotally couple the pivot bracket 110 to the spin ring 108, the second aperture 704 in the bottom portion 703 of each arm (711, 713) of the pivot bracket 110 may be aligned with correspondingly located apertures 602 in the spin ring 108, and a fastener may be passed through the aligned apertures (602, 704). At least one of the pivot arms (711 or 713) of the pivot bracket 110 may be coupled to the spin ring 108 using a quickly releasable/adjustable fastener, such as a wing nut fastener 302.

The apertures (704*a*, 704*b*) located at the bottom portion 703 of each arm (711, 713) of the pivot bracket 110 form a first set of pivot points that allow the pivot bracket 110 to pivotally rotate with respect to the spin ring 108 (or trim assembly 101) along a first axis of rotation 490 defined by and axially passing through the aperture 704*a* of the pivot bracket's first arm 711 and aperture 704*b* of the pivot bracket's second arm 713.

In addition to pivotally coupling the bottom portion (703*a*, 703*b*) of each arm (711, 713) of the pivot bracket 110 to the spin ring 108, the top portion (701*a*, 701*b*) of each arm (711, 713) of the pivot bracket 110 may be pivotally coupled to the socket bracket 112. In particular, to pivotally couple the pivot bracket 110 to the socket bracket 112, the first aperture 706 in the top portion 701 of each arm (711, 713) of the pivot bracket 110 may be aligned with correspondingly located apertures 808 (shown in FIG. 8) of the socket bracket 112, and a fastener may be passed through the aligned apertures (808, 706). In some example embodiments, at least one of the pivot arms (711 or 713) of the pivot bracket 110 may be coupled to the socket bracket 112 using a quickly releasable/adjustable fastener, such as a wing nut fastener 302. Alternatively, in other example embodiments, fasteners such as screws or rivets may be used on both the pivot arms (711 and 713) to couple the pivot bracket 110 to the socket bracket 112 and/or the spin ring 108.

The apertures (706*a*, 706*b*) located at the top portion 701 of each arm (711, 713) of the pivot bracket 110 form a second set of pivot points that allow the socket bracket 112 to pivotally rotate with respect to the pivot bracket 110 along a second axis of rotation 492 defined by and axially passing through the aperture 706*a* of the first arm 711 and aperture 706*b* of the second arm 713 of the pivot bracket 110.

As illustrated in FIG. 8, the socket bracket 112 may include a top member 802 and two side arms (804, 806) that extend substantially perpendicular to the top member 802 from opposite edges of the top member 802 forming a may be a substantially U shaped bracket. Each side arm (804, 806) may include an aperture 808 that is configured to pivotally couple the socket bracket 112 to the pivot bracket 110 as described above.

Further, the top member 802 of the socket bracket 112 may include an aperture 809 that is large enough to receive a base portion of the light source 116. In particular, the base portion of the light source 116 may be coupled to a socket 114 that is disposed on the top member 802 of the socket bracket 112 and aligned with the aperture 809 of the socket bracket 112. In other words, as illustrated in FIGS. 1-4, the light source 116 may be positioned within the light fixture 100 such that a base portion of the light source 116 is received through the aperture 809 on the top member 802 of the socket bracket 112 and a remainder portion of the light source 116, i.e., the light emitting portion faces downwards towards the light emitting opening 591 of the trim unit 102. In particular, the light source 116 may be coupled to the socket 114 through the socket bracket 112 such that a movement of the socket bracket 112 may result in a similar/proportional movement of the light source 116 as illustrated in FIGS. 9A-9C.

Figure 9B:
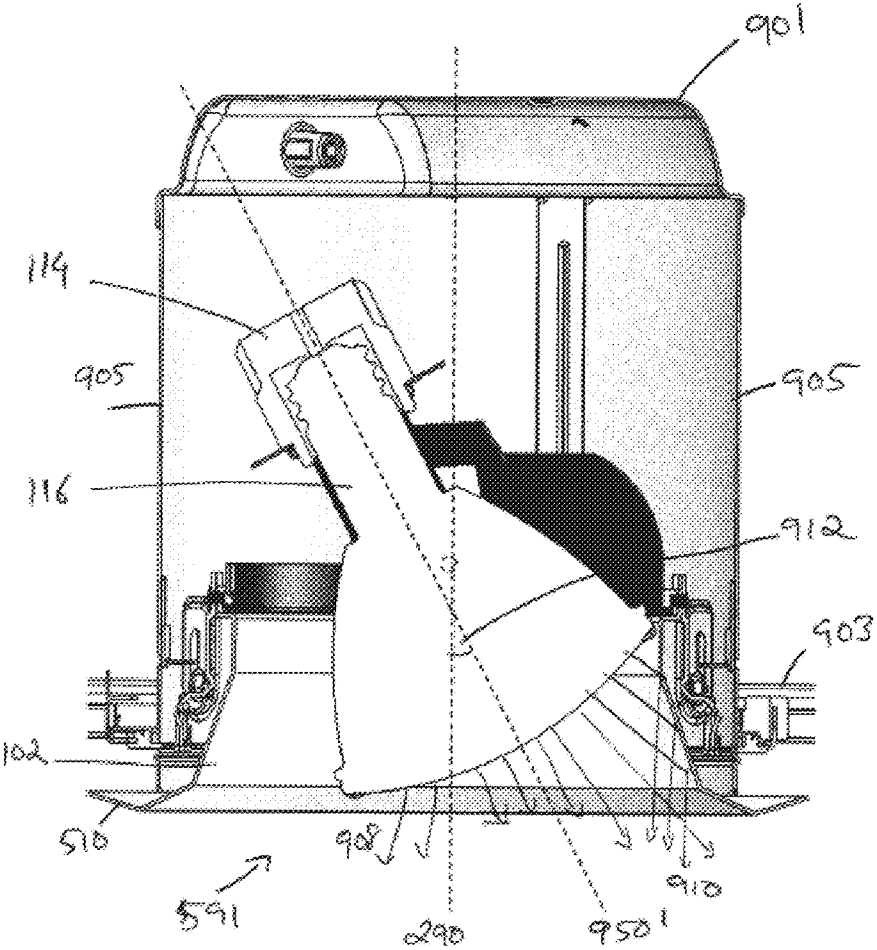
FIGS. 9A-9D (collectively 'FIG. 9') illustrate a rotation of the recessed light fixture of FIG. 1 disposed in a housing canister along its multiple pivot points, in accordance with an example embodiment of the lighting module.
Figure 9A:
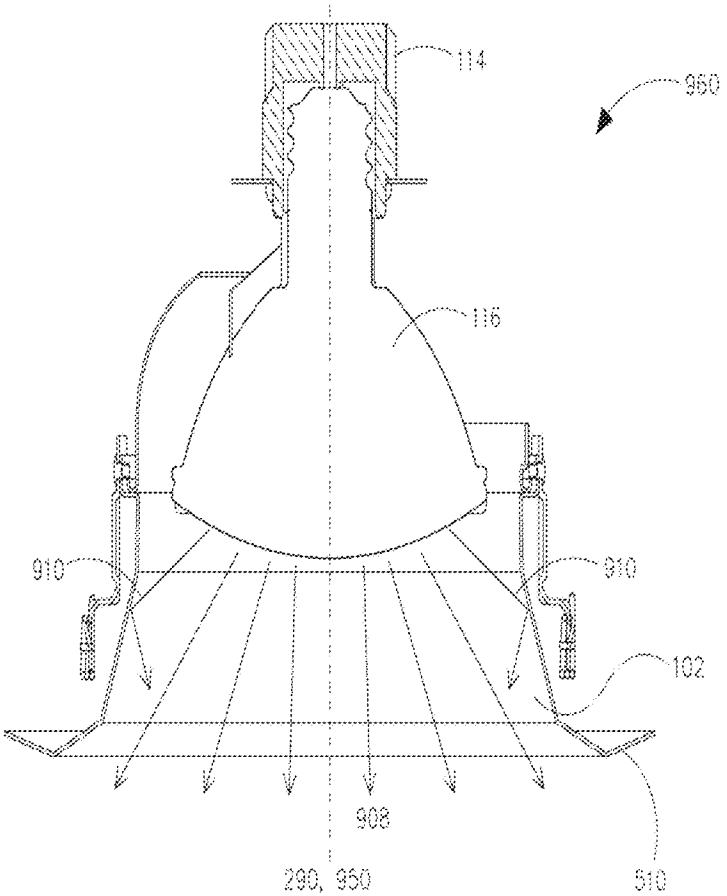
Figure 9D:
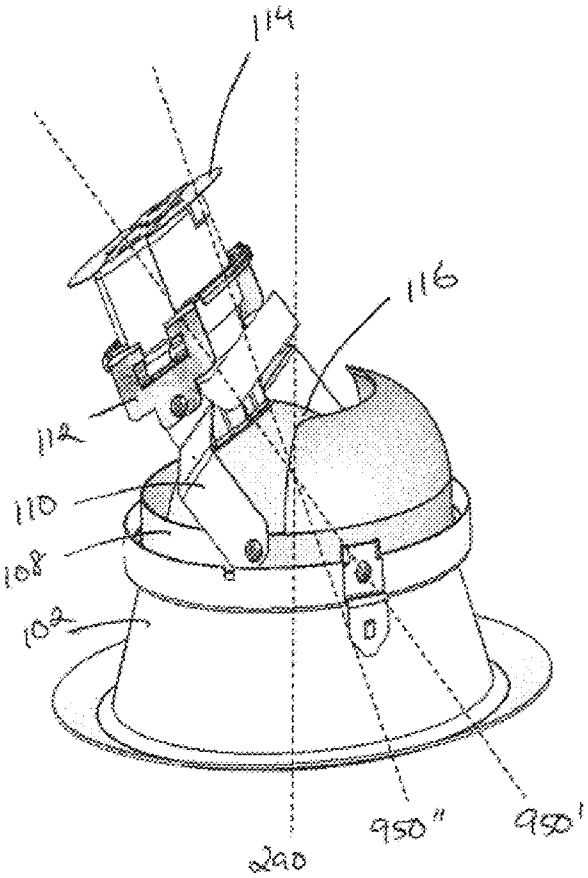
Figure 9C:
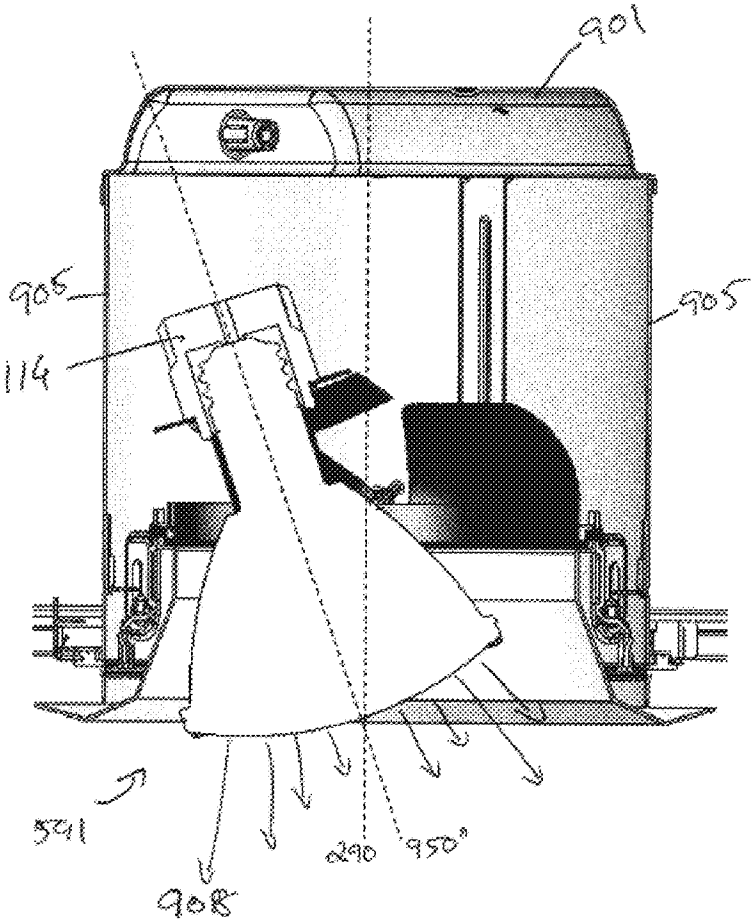

Turning to FIGS. 9A-9C, the figures illustrate a rotation of the recessed light fixture of FIG. 1 disposed in a housing canister along its multiple pivot points, in accordance with an example embodiment of the lighting module. In particular, once the recessed lighting fixture 100 is installed within the housing canister 901 and/or the ceiling 903, the flange 510 of the trim unit 102 grips or engages the ceiling and/or the housing canister 901 rendering the trim unit 102 stationary. Accordingly, in order to adjust the light source 116 of the recessed light fixture 100 to a desired position, a user may have to rotate/adjust the pivot bracket 110 with respect to the stationary trim unit 102 about the first axis of rotation 490 and/or the socket bracket 112 with respect to the pivot bracket 110 about the second axis of rotation 492.

In certain example embodiments, in order to rotate/adjust the pivot bracket 110 about the first axis of rotation 490, the user may have to: rotate/adjust the pivot bracket 110 about the first axis of rotation 490, and hold the pivot bracket 110 in the desired position. Similarly, in order to rotate/adjust the socket bracket 112 with respect to the pivot bracket 110 about the second axis of rotation 490, the user may have to: rotate/adjust the socket bracket 112 about the second axis of rotation 490, and hold the socket bracket 112 in the desired position. One of ordinary skill in the art can understand and appreciate that the above-mentioned mechanism to rotate/adjust the pivot bracket and the socket bracket may be an example and may not be limiting. That is, any other appropriate mechanism may be used to rotate/adjust the pivot bracket 110 and the socket bracket 112 without departing from a broader scope of the present disclosure.

As described above, a user may rotate/adjust the pivot bracket 110 about the first axis of rotation 490 to aim the light source 116 of the recessed light fixture 100 at a maximum angle with respect to a central axis 290 of the recessed lighting fixture. The central axis 290 as described herein may refer to an axis that axially passes through a center of the trim unit's light source receiving opening 590 defined by the top annular edge 512 of the trim unit 102 and a center of the trim unit's light emitting opening 591 defined by the bottom annular edge 514 of the trim unit 102.

In certain example embodiments, the maximum angle at which the light source 116 may be aimed by rotation of the pivot bracket 110 may be constrained by how far pivot bracket 110 can rotate before the socket bracket 112 and/or the socket 114 of the recessed light fixture 100 engages a side wall 905 of the housing canister 901 (in an embodiment with a housing canister 901) and/or before the arms (711, 713) of pivot bracket 110 engage a portion of the spin ring 108 (in an embodiment without a housing canister 901). Once the light source 116 is aimed at a maximum angle desired by the user and allowed by the constraints of the recessed lighting fixture 100 as described above, the user may rotate/adjust the socket bracket 112 about the second axis of rotation 492 to direct the center beam of the light source onto the desired area/surface. The additional rotational axis increases the amount of direct (non-reflected) usable light output from the recessed light fixture while being in maximum/deep regression.

For example, initially, the light source 116 may be set in a first position 960 within the recessed light fixture 100 as illustrated in FIG. 9A, where the light source 116 faces downward toward the trim unit's light emitting opening 591 and an axis 950 normal to and passing through the center of the light source (herein 'central axis of the light source 116') may be aligned with the central axis 290 of the recessed light fixture 100. When the light source 116 is in the first position 960, most of the light emitted from the light source 116 may directly exit the light fixture 100 through the light emitting opening 591 of the trim unit 102 (herein 'direct light 908'). However, a small portion of the light emitted by the light source 116 may be directed towards an inner surface of the trim unit 102 that may have reflective properties and/or may have a reflective coating. Accordingly, the light received by the inner surface of the trim unit 102 may be reflected towards the light emitting opening 591 (herein 'reflected light 910). The reflected light 910 may reduce a perceived brightness of the light emitted by the light source 116, and hence, it may desirable to minimize the reflected light 910 and increase the direct light 908 emitted from the light source 116.

In said example, a user may change the position of the light source 116 from the first position 960 to another desired position to illuminate a desired area within a room in which the recessed light fixture 100 is installed. For example, the user may desire to illuminate a corner of the room instead of an area directly below the recessed lighting fixture 100 as in FIG. 9A. In order to change a position of the light source 116, the user may adjust the pivot bracket 110 about a first axis of rotation 490 and/or a socket bracket 112 about a second axis of rotation 492 as described above. For example, as illustrated in FIG. 9B, the user may rotate the pivot bracket 110 with respect to the stationary trim unit 102 about the first axis of rotation 490 to aim the light source 116 at a maximum desired angle 912 (central axis of the light source 116 at second position 950') from the central axis 290 of the recessed light fixture 100. However, as illustrated in FIG. 9B, at the maximum desired angle 912, the amount of direct (non-reflected) usable light 910 is reduced because the light source 116 is positioned such that most of the light emitted by the light source 116 is obstructed by the trim unit 112 which reflects the light towards the light emitting opening 591. That is, even though the desired area to be illuminated may receive light, the brightness of the light may be minimized due to higher amount of reflected light 910 and less amount of direct (non-reflected) usable light 910.

In said example, to increase the amount of direct usable light 910, the user may adjust the socket bracket 112 about a second axis of rotation 492 as illustrated in FIGS. 9C and 9D. That is, once the pivot bracket 110 is rotated and locked in a position that aims the light source at the maximum desired angle 912, the user may rotate/adjust the socket bracket 112 with respect to the pivot bracket 110 about the second axis of rotation 492 to direct the central axis 950 of the light source 116 to a second position 950" such that the desired area to be illuminated receives more direct light 910 than reflected light 908. That is, the socket bracket 112 is rotated with respect to the pivot bracket 110 about the second axis of rotation 492 to direct the center beam of the light source (which is the central portion of the cone of light) onto the desired area/surface.

Even though FIGS. 9A-9D illustrate a specific adjustment of the recessed light fixture, one of ordinary skill in the art can understand and appreciate that the pivot bracket and the socket bracket of the recessed light fixture may be adjusted in any other appropriate manner or to any other appropriate positions as desired by the user without departing from a broader scope of the present disclosure.

Although the inventions are described with reference to example embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the example embodiments, equivalents of the elements shown therein will suggest themselves to those skilled in the art, and ways of constructing other embodiments of the present invention will suggest themselves to practitioners of the art. Therefore, the scope of the present invention is not limited herein.

What is claimed is:

1. A lighting system comprising:

a trim assembly comprising a light source receiving opening, a light emitting opening, and a trim body extending from the light source receiving opening to the light emitting opening;

a pivot bracket comprising a first arm and a second arm;

a socket bracket comprising a top member and two side flanges, each side flange extending substantially perpendicular to the top member from opposite edges of the top member; and a light source coupled to the socket bracket via a light source receiving member disposed on the top member of the socket bracket such that a light emitted by the light source exits through the light emitting opening of the trim assembly, wherein the pivot bracket is pivotably coupled to:

(i) the trim assembly at a proximal end of the first arm and the second arm and defining a first axis of rotation, and (ii) each side flange of the socket bracket at a distal end of the first arm and the second arm, respectively, and defining a second axis of rotation, wherein the light source receiving opening, the light emitting opening, and the trim body define a trim unit of the trim assembly, wherein the trim assembly further includes a spin ring that is coupled to the trim unit, wherein the spin ring comprises an annular ring and a partial dome that extends above the annular ring and partially along a circumference of the annular ring from a top edge of the annular ring, and wherein the spin ring comprises a stopper projection disposed on an outer surface of a sidewall of the annular ring to prevent a rotation of the spin ring beyond a predetermined rotational angle when the stopper projection engages a stopper tab in the trim unit.

2. The lighting system of claim 1, wherein the pivot bracket is pivotable with respect to the trim assembly about the first axis of rotation to aim the light source at a maximum angle with respect to a central axis of the lighting system, and wherein the trim assembly is stationary when installed.

3. The lighting system of claim 1, wherein the socket bracket is pivotable with respect to the pivot bracket about the second axis of rotation to adjust a center beam of the light source towards a desired area of illumination, and wherein pivoting the socket bracket proportionally pivots the light source.

4. The lighting system of claim 1, wherein each of the first arm and the second arm of the pivot bracket includes a first aperture located near a proximal end of the respective arm and a second aperture located near a distal end of the respective arm.

5. The lighting system of claim 4, wherein the set of first apertures of the first arm and the second arm defines the first axis of rotation that passes axially through the set of first apertures, and wherein the set of second apertures of the first arm and the second arm defines the second axis of rotation that passes axially through the set of second apertures.

6. The lighting system of claim 1, wherein the top member surface of the socket bracket includes an aperture, and wherein a portion of the light source passes through the aperture in the socket bracket's top member surface and a remainder portion of the light source extends towards the light source receiving opening of the trim assembly such that light emitted by the light source exits through the light emitting opening of the trim assembly.

7. The lighting system of claim 1, wherein the pivot bracket is pivotably coupled to the trim assembly and the socket bracket using one or more adjustable fasteners.

8. The lighting system of claim 1, wherein the pivot bracket comprises a connector band that couples the first arm to the second arm.

9. The lighting system of claim 1, wherein the pivot bracket is pivotably coupled to the spin ring of the trim assembly, and wherein the spin ring and the pivot bracket, the socket bracket, and the light source coupled to the spin ring are rotatable about a central axis of the lighting system.

10. The lighting system of claim 8, wherein the connector band is positioned at a distal end of the pivot bracket near the set of second apertures.

11. A lighting fixture comprising:

a pivot bracket that is pivotably couplable to a trim assembly at a first end of the pivot bracket and comprising a first arm and a second arm;

a socket bracket pivotably coupled to a second end of the pivot bracket, wherein the first end is opposite to the second end, wherein the first end of the pivot bracket comprises a first end of each of the first arm and the second arm, and wherein the second end of the pivot bracket comprises a second end of each of the first arm and the second arm; and a light source coupled to the socket bracket and configured to emit light toward an opening in the trim assembly, wherein each of the first arm and the second arm comprises:

a substantially planar top portion, a substantially planar bottom portion, and a curved middle portion that extends from the substantially planar top portion to the substantially planar bottom, and wherein the curved middle portion separates the substantially planar top portion from the substantially planar bottom portion both vertically and horizontally such that a distance between the substantially planar bottom portions of the first arm and the second arm is greater than a distance between the substantially planar top portions of the first arm and the second arm.

12. The lighting fixture of claim 11, wherein the substantially planar top portion and the substantially planar bottom portion of each of the first arm and the second arm are substantially parallel to each other.

13. The lighting fixture of claim 11, wherein the substantially planar top portion of each pivot bracket arm includes a first aperture and the substantially planar bottom portion of each pivot bracket arm includes a second aperture.

14. The lighting fixture of claim 13, wherein the set of first apertures of the first arm and the second arm define a first axis of rotation that passes axially through the set of first apertures, and wherein the set of second apertures of the first arm and the second arm define the second axis of rotation that passes axially through the set of second apertures.

15. The lighting fixture of claim 14, wherein the pivot bracket is pivotable with respect to the trim assembly along the first axis of rotation to aim the light source at a maximum angle with respect to a central axis of the lighting system.

16. The lighting fixture of claim 14, wherein the socket bracket is pivotable with respect to the pivot bracket along the second axis of rotation to adjust a center beam of the light source towards a desired area of illumination, and wherein pivoting the socket bracket proportionally pivots the light source.

17. The lighting fixture of claim 11, wherein the pivot bracket is pivotably coupled to the trim assembly and the socket bracket using one or more adjustable fasteners.

18. The lighting fixture of claim 11, wherein the pivot band further comprises a connector band that couples the first arm to the second arm, wherein one end of the connector band is a curved member, and wherein one end of the connector band is coupled to the substantially planar top portion of the first arm and the opposite end of the connector band is coupled to the substantially planar top portion of the second arm.

* * * * *